US006036277A

United States Patent [19]

Weihrauch

[11] Patent Number: 6,036,277

[45] Date of Patent: Mar. 14, 2000

[54] METHOD FOR THE MANUFACTURE OF BRUSHWARE

[75] Inventor: Georg Weihrauch, Wald-Michelbach, Germany

[73] Assignee: Coronet-Werke GmbH, Wald-Michelbach, Germany

[21] Appl. No.: 08/919,223

[22] Filed: Aug. 26, 1997

Related U.S. Application Data

[63] Continuation of application No. PCT/EP96/00616, Feb. 14, 1996.

[51] Int. Cl.[7] ..... A46D 1/08; A46D 3/00

[52] U.S. Cl. ..... 300/21; 15/186; 15/193; 264/243

[58] Field of Search ..... 15/186, 191.1, 15/193, 187, 188, 190, 192; 300/21, 8; 264/243

[56] References Cited

U.S. PATENT DOCUMENTS

| | | | |
|---|---|---|---|
| Re. 27,455 | 8/1972 | Lewis, Jr. | 300/21 |
| 65,029 | 5/1867 | White | 15/190 |
| 196,802 | 11/1877 | Hill | 15/190 |
| 1,919,010 | 7/1933 | Connor | 15/190 |
| 3,425,084 | 2/1969 | Laurence et al. | 300/21 |
| 3,641,610 | 2/1972 | Lewis, Jr. | 300/21 |
| 4,609,228 | 9/1986 | Bickel | 300/21 |
| 4,637,660 | 1/1987 | Weihrauch | 300/21 |
| 4,988,146 | 1/1991 | Weihrauch | 15/191.1 |
| 5,538,328 | 7/1996 | Lewis, Jr. | 300/21 |

FOREIGN PATENT DOCUMENTS

| | | | |
|---|---|---|---|
| 142885A2 | 5/1985 | European Pat. Off. . | |
| 504893A1 | 9/1992 | European Pat. Off. . | |
| 743747 | 4/1933 | France | 15/190 |
| 845933 | 6/1953 | Germany . | |
| 937765 | 1/1956 | Germany | 15/186 |
| 3511528C | 10/1985 | Germany . | |
| 516995 | 1/1940 | United Kingdom | 15/186 |
| 657825 | 9/1951 | United Kingdom | 15/191.1 |
| 9217092 | 10/1992 | WIPO . | |
| 9217093 | 10/1992 | WIPO . | |

*Primary Examiner*—Gary K. Graham
*Attorney, Agent, or Firm*—Antonelli, Terry, Stout & Kraus, LLP

[57] ABSTRACT

A method and an apparatus for the manufacture of brushes, and brushes manufactured according to such method. A bristle carrier of a elastic material is provided with at least one substantially cylindrically elongated recess. An elongated bristle bundle is inserted into the elongated recess. The bristle bundle has a thickened portion at its insertion end with a transverse cross-section larger than the narrowest transverse cross-section of the recess. The longitudinal axis of the bristle bundle is aligned with the longitudinal axis of the recess, and a force is applied longitudinally on the thickened portion to cause a wall of the recess to elastically spring out so as to permit passage of the thickened portion. After passage of the thickened portion, the wall springs back until engagement of the wall on the bristle bundle occurs to secure the bristle bundle in the recess.

13 Claims, 5 Drawing Sheets

METHOD FOR THE MANUFACTURE OF BRUSHWARE

CROSS-REFERENCE TO RELATED APPLICATION

This application is a continuation of PCT Application No. PCT/EP96/00616, filed Feb. 14, 1996.

FIELD OF THE INVENTION

The invention relates to a method of manufacturing brushware in which the brushware is in the form of a bristle carrier made from elastic material and having at least one substantially cylindrical recess for receiving a bristle bundle, the carrier having on one end a bristle-connecting thickened portion whose cross-section is larger than the narrowest cross-section of the recess and which is positively inserted under pressure into the recess on the bristle carrier, the wall of the recess on insertion of the thickened portion springing out elastically and springing back behind the thickened portion until engagement takes place with the bristles of the bristle bundle. The invention also relates to an apparatus for performing the method and to the brushware manufactured according thereto.

BACKGROUND OF THE INVENTION

In the present context brushware is understood to mean all products in which bristle bundles or individual bristles are fastened to a carrier or support having any shape. These can be conventional brushes, such as toothbrushes, body brushes, cleaning brushes, scrubbers, brooms, abrading brushes, polishing brushes, etc. The carrier or support can be a handle, grip or appliance casing, as well as bands, strips, etc., or only preliminary products which are subsequently inserted in a handle, grip, appliance, etc. or are interconnected to form larger units. Bristle bundles are bundles having any appropriate cross-section, e.g. tubular bundles, polygonal bundles, hollow bundles, bundle packs, etc. The bristles are made from plastic, and the thickened portion can be produced by melting the bristle ends and cooling, and optionally by after-shaping.

The aim with plastics brushes was to obviate the previously used mechanical fastening method or the adhesion method. Thus, it is known (DE 845 933), to provide the bristle bundles with a thickened portion, by melting the bristles, and to inject the bristle carrier material around said thickened portion, so as to anchor the bristle bundle in extraction-proof manner in the carrier. This injecting in of the bristle bundle has subsequently been improved (DE 35 11 528, EP 142 885).

In another technology the bristle carrier is provided with preshaped recesses and either melted in the vicinity of the recess and/or the thickened portion on the bristle bundle in a zone close to the surface, and the bristle bundle with the thickened portion is pressed into the recess (U.S. Pat. No. 4,609,228, U.S. Pat. No. 4,637,660). Following insertion the bristle carrier melt flows round the thickened portion, and at the same time there can be a melting together of the plastic components of the bristle bundle and the carrier.

Finally, a thermoelastic joining method is known (U.S. Pat. No. 4,988,146), in which the wall of the recess and/or the thickened portion on the bristle bundle are heated in the zone close to the surface to temperatures below the melting point and subsequently the bristle bundle with the thickened portion is inserted, accompanied by thermoelastic deformation. After cooling the bundle is firmly anchored with the thickened portion in the carrier.

In all these cases heat must be supplied and then removed, which always takes time, so that in these known methods the working cycles are relatively long. In addition, the temperature must be very accurately controlled, so as to avoid thermal damage, particularly embrittlement or thermal oxidation of the polymers. In no case is it possible to prevent deterioration to the molecular structure of the bristles with their often very small diameter.

For special brushes, particularly hair brushes, it is known (DE 937 765) to provide bag-like depressions on a plate-like, rubber-like carrier and to insert in such depressions wire or plastic pins, or also bristle bundles with a thickening at the fastening-side end. On insertion the wall of the bag-like depression elastically gives way and springs behind the thickened portion until it engages on the pin or bundle. Subsequently the plate is marginally fixed in a brush body and curved out, so that it springs through when the brush is in use.

SUMMARY OF THE INVENTION

The problem of the invention is to provided a method and an apparatus for the manufacture of brushware and brushware manufactured according thereto, which permit an inexpensive manufacture with short working cycles, whilst obtaining brushware with improved bristle bundle extraction resistance.

Based on the known method of DE 937 765, the problem is solved in that the bristle bundle has its axis aligned with the axis of the recess in the bristle carrier and is driven into the recess by the direct action of a force to the thickened portion.

The force to be applied for driving in is decisively dependent on the modulus of elasticity of the bristle carrier material and on how the thickened portion and recess are geometrically dimensioned and matched to one another. These parameters can be easily determined by a few tests, as a function of the brushware type to be manufactured. Then, in troublefree manner, driving in forces of the necessary magnitude can be produced and transferred to the thickened portion on the bristle bundle, so that following driving in on the bristle bundle an extraction resistance is obtained, which is close to that of conventionally manufactured brushware. The axis of the bristle bundle and the recess preferably are brought into alignment, however, a slight slope or offset is not detrimental as the thickened portion centers itself. Otherwise the method is not only applicable with bristle bundles, but also with single bristles so long as they have a thickened portion at their fastening-ends.

The force for driving in the bristle bundle is preferably uniformly applied to the projecting length of the thickened portion projecting circumferentially in annular manner over the bristles of the bristle bundle.

If the bristle bundles are constructed as hollow bundles, in which the bristles are arranged in annular manner, the thickened portion at least partly also projects into the cross-section of the cavity, but can also terminate the latter in plate-like manner. With such hollow bundles, according to the invention the force for driving in the bristle bundles is applied to the thickened portion within the cavity.

It is advantageous and known per se for the recess in the bristle carrier to have an undercut. In this case the force for driving in the bristle bundle is made to act on the thickened portion until the latter has reached the largest cross-section of the recess behind the undercut.

As a rule a brushware article, e.g. a brush, has a plurality of bristle bundles and the bristle carrier a corresponding number of recesses. The method according to the invention offers the possibility of simultaneously driving all the bristle bundles or groups of bundles into the recesses on the bristle carrier.

In addition to the force becoming effective on driving in the thickened portion, a force can also be applied to the free ends of the bristle bundles whereby the bundle preferably is clamped on its periphery to prevent the bristles from buckling.

When increased demands are made on the extraction resistance, it is appropriate to insert the elastic bristle carrier with the inserted bristle bundles in a rigid support, accompanied by clamping or bracing of the bristle carrier.

For performing the method, the invention is based on an apparatus with a receptacle for the bristle carrier and a holder for the bristle bundle. According to the invention, such an apparatus is characterized in that the holder has a punch, whose leading front end acts on the thickened portion on the bristle bundle and is driven axially in the direction of the receptacle with the bristle carrier and can be inserted in the recess up to the final positioning of the thickened portion.

Thus, the punch passes into the recess together with the bristle bundle and outwardly displaces the elastically resilient wall of the recess until the thickened portion has reached its final position. Following the extension of the punch, the elastic wall of the recess springs back, fixes the thickened portion and simultaneously embraces the bristles of the bundle, to the extent that they are located within the bristle carrier.

The punch can be constructed as a sleeve externally embracing the bristle bundle and which acts with its annular front end against the projecting length of the thickened portion projecting over the bristles of the bristle bundle. Such a sleeve-like punch simultaneously guides the bristle bundle and applies the lateral displacement forces to the elastic material of the bristle carrier. Advantageously the sleeve has on its area acting on the projecting length of the thickened portion an external cross-section, which is not larger than the greatest cross-section of the thickened portion and then, accompanied by the formation of a step, has a larger cross-section. The step forms a stop or abutment cooperating with the bristle carrier surface for the driving in depth of the bristle bundle.

In the case of hollow bundles the punch has a bolt-like construction. It engages in the hollow bundle and acts with its leading front end on the thickened portion projecting over the internal diameter of the hollow bundle. If the thickened portion is so constructed that it terminates in the downwards direction the hollow bundle in a plate-like manner, the punch acts on the inside of the plate-like thickened portion.

In the case of an annular thickened portion, according to a preferred embodiment the punch can have a smaller diameter part engaging in the annular space of the thickened portion and the step formed on the punch as a result of this acts at the time of driving in on the inside projecting length of the annular thickened portion.

In conjunction with the method of the invention and the apparatus for performing, it the bristle carriers are chosen from a material which is rubber-like at normal temperature and whose elasticity is so adjusted as a function of the ratio of the cross-sections of the recess and thickened portion that after driving the bundle into the recess, the thickened portion is positively held due to the resilience of the bristle carrier material and the bristle bundle over its length located in the carrier, is closely embraced by the latter, without significant cavities being left. The material for the carrier or its elasticity must be adjusted in such a way and the geometrical dimensions of the recess and the thickened portion must be so matched to one another that the bristle bundle can be inserted with an acceptable force expenditure, but at the same time an extraction resistance is achieved, which satisfies the intended use of the brushware. Materials satisfying these conditions are natural and artificial rubbers, as well as a number of known elastomers.

It is obvious that the manufacturing procedure for such brushware with high bundle extraction resistance is much simpler than the hitherto used thermoplastic or thermoelastic methods, because fastening can take place under normal temperatures. This considerably reduces apparatus costs, and in particular much shorter cycle times are possible than can be obtained with mechanical fastening procedures. The further advantage is achieved, compared with the latter procedures that there is no need for additional or unusual fastening means.

Brushware constructed according to the invention also has improved use characteristics, in that the rubber-like nature of the carrier in many applications offers advantages, e.g. there is a reduction in the injury risk in the case of toothbrushes, cosmetic brushes, body brushes, etc. In the case of brushes, brooms, etc. used for cleaning purposes, as well as technical and industrial brushes, the damage risk to other objects in the movement area of the brush is reduced, and favourable damping properties result from the elastomeric behaviour, which is particularly advantageous with mechanically driven brushes.

This obviates the hitherto necessary very complicated measures for producing flexible brushes from otherwise rigid materials, such as is widely described in the prior art (WO 92/17092, WO 92/17093, EP 504 893).

The invention also relates to brushware in which the bristle carrier is made from rubber-like material with inserted bristle bundles having elasticity which are placed in corresponding recesses of a less elastic to rigid carrier or support, which encloses and fixes in frame-like manner the elastomeric carrier. This recess can optionally be undercut. The rigid support can form the brush grip or handle.

The rubber-like nature of the carrier not only leads to the elasticity thereof, but at the same time forms a damping mounting for the bristle bundle, so that the latter is movable axially and transversely to the axis to a limited extent. Such an elasticity is in particular desirable in toothbrushes. The mobility of the bristle bundle can, in the latter construction, be assisted in that the carrier has cavities on its side remote from the bristle bundle. If this carrier is inserted in a rigid body, then the rubber-like material of the carrier can fall back into these cavities when force is exerted on the bristles, so that, as a function of the arrangement of the cavities, the bristle bundle can give way to a greater or lesser extent axially or transversely thereto.

Alternatively, the bristle carrier from the rubber-like material can at the same time form a grip and have in the area of the latter a greater stiffness. In this construction the bristle carrier and grip are constructed in one piece.

A greater stiffness in the grip area can be achieved by stiffening inserts or envelopes, or by material restructuring, e.g. by foaming only in the grip area. The necessary stiffness can also be ensured by larger cross-sections in the grip area.

According to a preferred development, the recess on the bristle carrier is undercut, the smallest cross-section of the recess being smaller than the cross-section of the thickened portion on the bristle bundle.

In this construction the self-closure between the bristle bundle and the carrier not only results from its rubber-like properties, but also is ensured by the shaping of the recess, the rubber-like properties ensuring that the thickened portion can pass through in troublefree manner the narrower cross-section on inserting the bristle bundle.

In another advantageous construction, the recess is provided on its opening rim with a larger diameter than the external diameter of the bristle bundle and then conically narrows with depth. Thus, initially the driving in of the bristle bundle is facilitated, in that the conical wall forms a type of insertion bevel for the thickened portion and the punch. The bristle bundle also has the possibility of giving way transversely to its axis, which is advantageous in certain applications.

The recess can also be constructed as a through hole in the bristle carrier, so that for the same axial alignment, the bristle bundle can be inserted in the carrier from one or other side.

In each of the aforementioned brushwares, the thickened portion on the bristle bundle can be given a spherical, lenticular or discoidal construction or can also taper conically in the axial direction of the bundle. The shaping is chosen as a function of the necessary extraction resistance or the desired mobility of the bundle transversely to its axis.

BRIEF DESCRIPTION OF THE INVENTION

The invention is described in greater detail hereinafter relative to non-limitative embodiments and the attached drawings, wherein:

FIGS. 1*a*, 1*b*, and 1*c* illustrate method stages on joining a bristle bundle to a bristle carrier in a first embodiment of the invention.

FIGS. 2*a*, 2*b*, and 2*c* depict various stages in the method of fixing another bundle type in a second embodiment of the invention.

FIGS. 3*a*, 3*b*, and 3*c* depict two variants of a third embodiment for the fastening of the bristle bundle.

FIGS. 4*a*, 4*b*, and 4*c* depict stages in fixing a bristle bundle in a further bristle carrier embodiment.

DETAILED DESCRIPTION

Figure 1C:
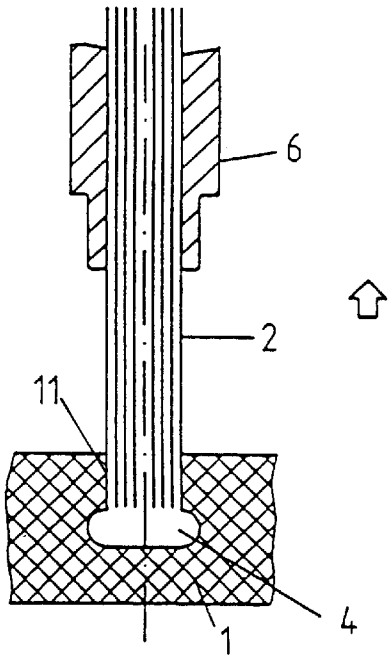
Figure 1B:
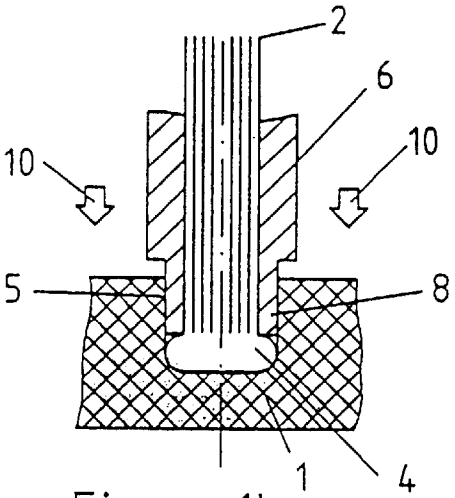
Figure 1A:
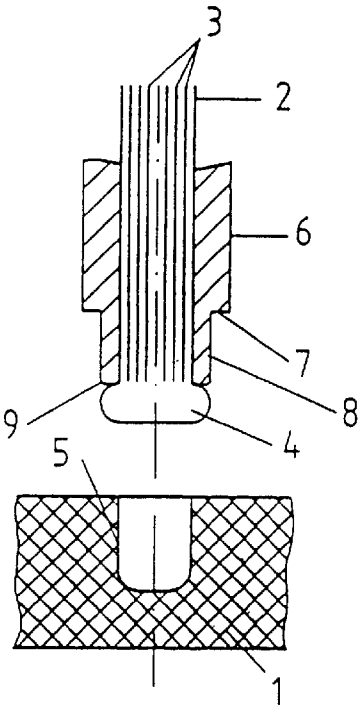

For ease of understanding, FIGS. 1 to 4 only show a detail from a bristle carrier 1 made from an elastomeric material in the vicinity of the fixing or fastening point of a bristle bundle 2. The bristle bundle 2 comprises a plurality of individual bristles 3, which are melted at their fastening-side end to a thickened portion 4, the latter then being pressed flat, e.g. compressed, so that it acquires a lenticular shape and projects outwards over the actual bundle. In the embodiment according to FIGS. 1*a* to 1*c* the bristle carrier 1 is provided with a cylindrical blind hole 5, whose diameter is smaller than the external diameter of the thickened portion 4.

The bristle bundle provided with the thickened portion 4 is driven or bounced into the blind hole 5 in the direction of its axis. In this embodiment use is made of an apparatus having a punch in the form of a sleeve 6 in which the bristle bundle is inserted in closely held manner. At its front end, the sleeve is drawn in at of a step 7 to a smaller diameter portion 8. The external diameter in the vicinity of the portion 8 is to be no larger than the external diameter of the thickened portion. The end face 9 of the portion 8 of the sleeve 6 (FIG. 1*a*) acts on the external diameter of the projecting length of the thickened portion 4 extending from the bristle bundle 2. Through the moving down of the sleeve 6 with the bristle bundle 2 corresponding to the directional arrows 10 in FIG. 1*b*, the thickened portion 4 is driven into the blind hole 5, whose wall is displaced outwards due to the elastomeric nature of the bristle carrier 1 unit until finally the thickened portion 4 strikes against the bottom of the blind hole 5. The sleeve 6 is then pulled outwardly (FIG. 1*c*), so that the wall of the blind hole springs back in area 11, and the thickened portion 4 and the bristles of the bundle 2 are closely secured over a certain length. The sleeve can be closed at its follow-up end, and with that closed face can exert an additional force to the free end of the bristle bundle when driving in the bundle.

Figure 2C:
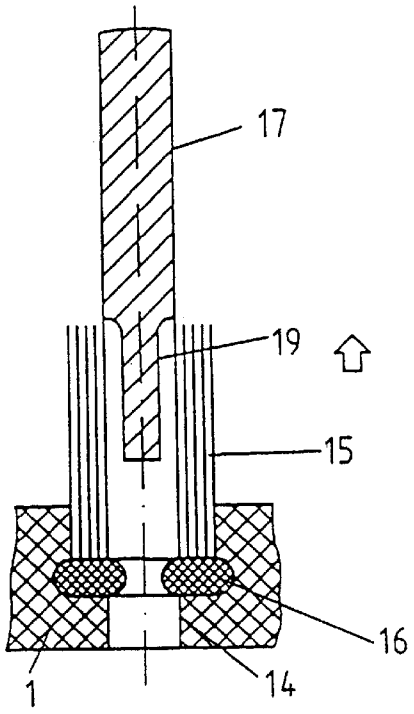
Figure 2B:
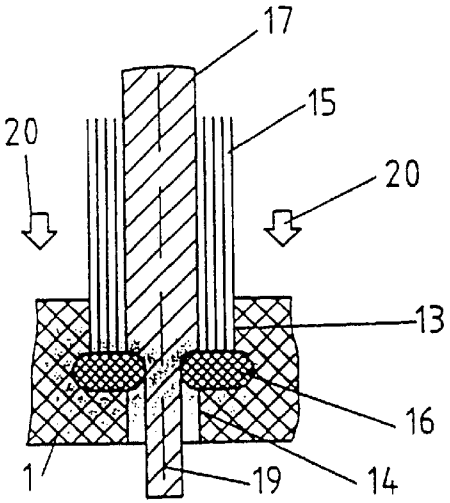
Figure 2A:
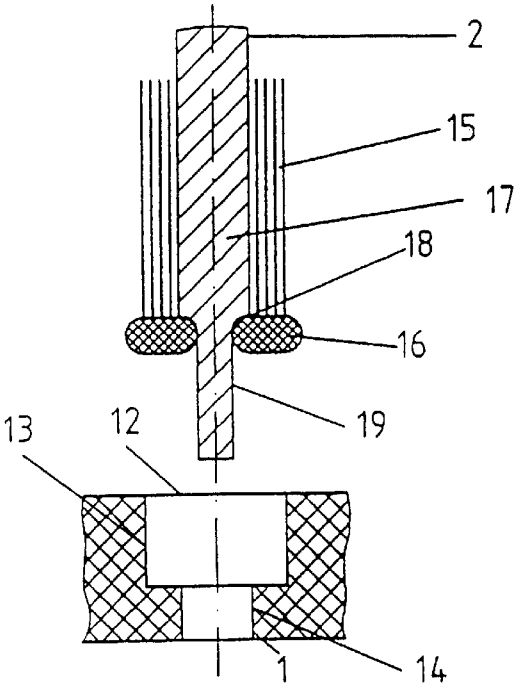

In the embodiment according to FIGS. 2*a*, 2*b* and 2*c*, the bristle carrier 1 has a through hole 12, which comprises a larger diameter portion 13 and a smaller diameter portion 14. In this case a bristle bundle 2 in the form of a hollow bundle 15 is inserted. The hollow bundle 15 is melted at its fastening end to an, in this case, annular thickened portion 16, and the latter is pressed flat by after-shaping. For inserting the hollow bundle 15, use is made of a bolt-like punch 17, which tapers over a step 18. The tapered portion 19 passes through the free inner space of the annular thickened portion 16 (FIG. 2*a*). On moving the punch 17 down in accordance with the directional arrows 20 in FIG. 2*b*, firstly the tapered portion 19 and then the thickened portion 16 pass into the two-step through hole 12. When the annular thickened portion 16 enters through hole 12 the wall of the portion 13 having the larger internal diameter is displaced outwards until the annular thickened portion 16 is located on the step between the two portions 13 and 14 of the hole. The wall then springs back in the vicinity of the larger portion 13 of the through hole 12, so that the annular thickened portion 16 is anchored. Here again, in the vicinity of the portion 13, the wall engages snugly from the outside on the bristle bundle, and then the punch 17 is pulled out.

Figure 3C:
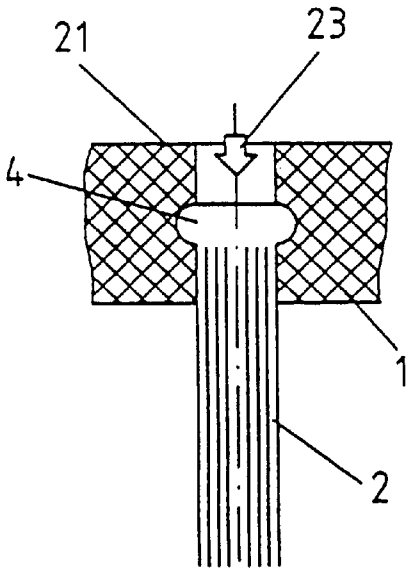
Figure 3B:
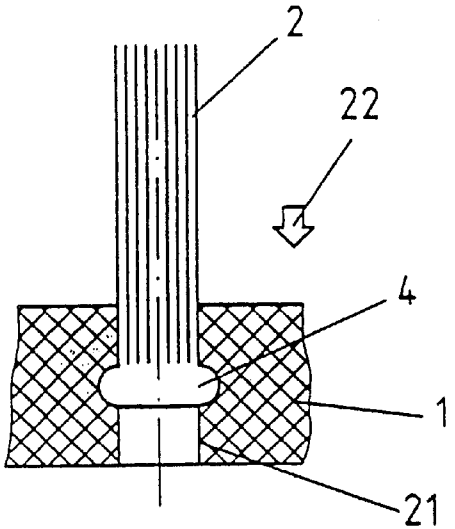
Figure 3A:
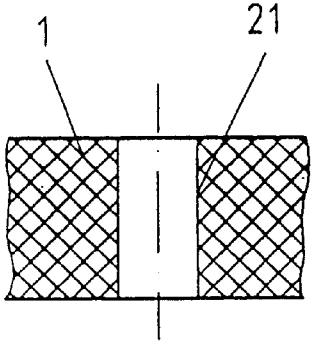

In FIGS. 3*a*, 3*b*, and 3*c* a bristle carrier 1 is provided with a through hole 21 that has a constant diameter over the bristle carrier thickness (FIG. 3*a*). In this embodiment the bristle bundle 2 with its thickened portion 4 at the front can be vibrated into the bristle carrier 1 from above with the thickened portion 4 entering hole 21 first according to the directional arrow 22, or with the bristles entering first according to the directional arrow 23 (FIG. 3*c*).

Figure 4C:
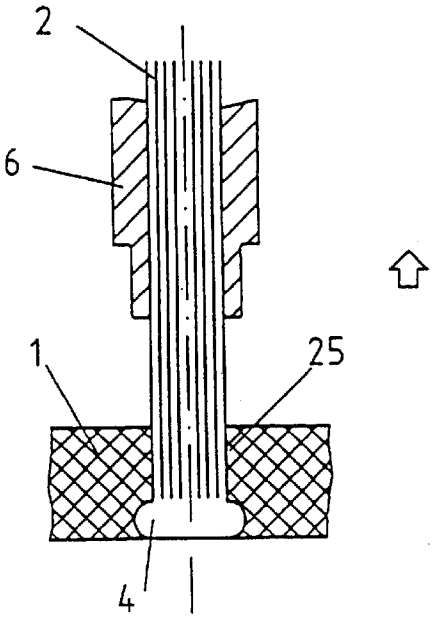
Figure 4B:
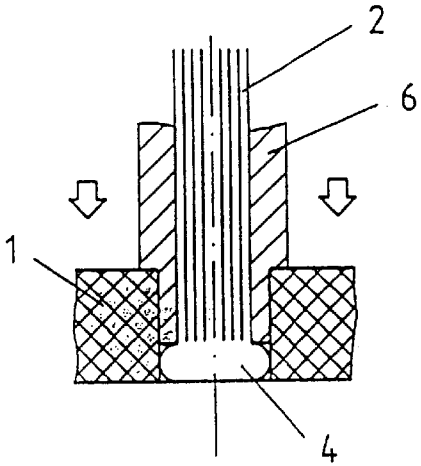
Figure 4A:
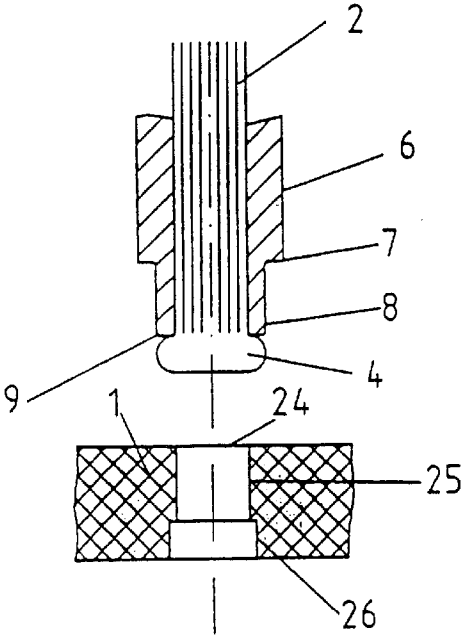

In the embodiment according to FIGS. 4*a*, 4*b*, and 4*c* the bristle carrier 1 once again has a two-step through hole 24, whose narrower portion 23 is located upstream of the further portion 26 in the driving in direction. Once again a bristle bundle 2 with the thickened portion 4 is vibrated in by means of a sleeve 6 as in FIGS. 1*a*, 1*b* and 1*c*. In this embodiment, at least in its portion 25, the blind hole 24 is narrower than the external diameter of the thickened portion 4, so that following insertion (FIG. 4*b*) and the return of the sleeve 6 (FIG. 4*c*), the thickened portion 4 is located in the further portion 26, whilst the wall of the portion 25 springs back and closely embraces the thickened portion on its top zone and the bristle bundle in the vicinity of the portion 25. Therefore, the bristle bundle is effectively anchored against tensile forces. To avoid a sliding of the bristle bundle out the other side, in this case the bristle carrier 1 can be inserted in a recess of a separately manufactured handle or the like.

In all the aforementioned embodiments the recess 5, 13, 21, 24 can conically widen in the vicinity of the opening edge in order to facilitate the driving in of the bundle. When using the brushes, the conical widening also gives the bundles a possibility to more strongly give way transversely to their axis than would be allowed by the elasticity of the carrier.

Figure 5:
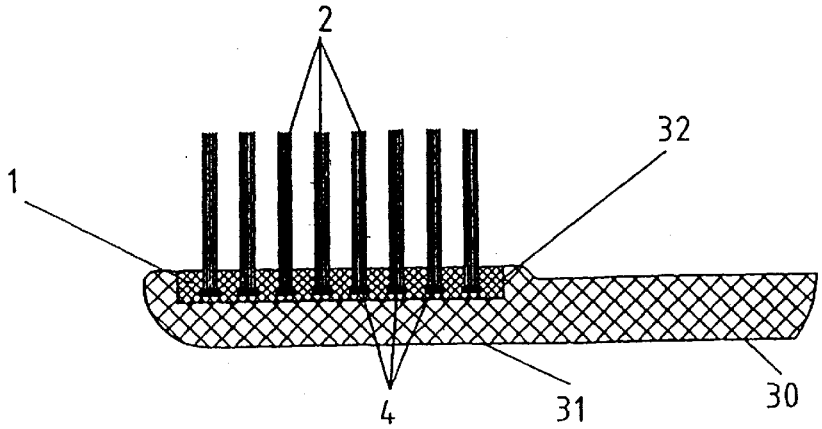
FIG. 5 is a broken away longitudinal sectional view taken in the vicinity of a toothbrush head.
Figure 6:
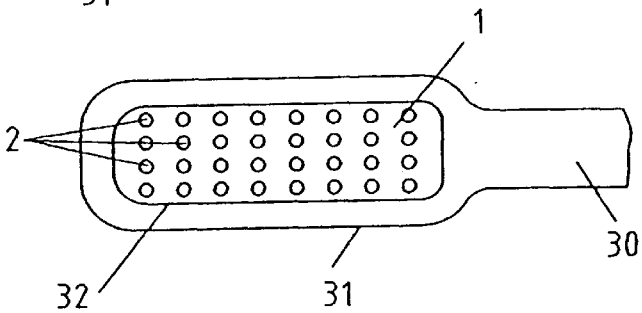
FIG. 6 is a plan view of the toothbrush head of FIG. 5.

FIG. 5 shows the head 31 of a toothbrush 30 in section. The head 31 has on its bristle side a recess 32, in which is inserted an elastomeric material bristle carrier 1 with the bristle bundles 2 fixed therein by driving in. Bouncing in can take place according to one of the above-described method variants. The recess 32 has a outline, which forms a somewhat smaller cross-section than the bristle carrier 1, so that the latter can also be fixed in the bristle head 31 by driving in. Naturally the bristle carrier can also be fixed by bonding, welding or anchoring in some other way on the brush head 31. FIG. 6 is a plan view of the bristle area of the brush head 31 according to FIG. 5.

Figure 7:
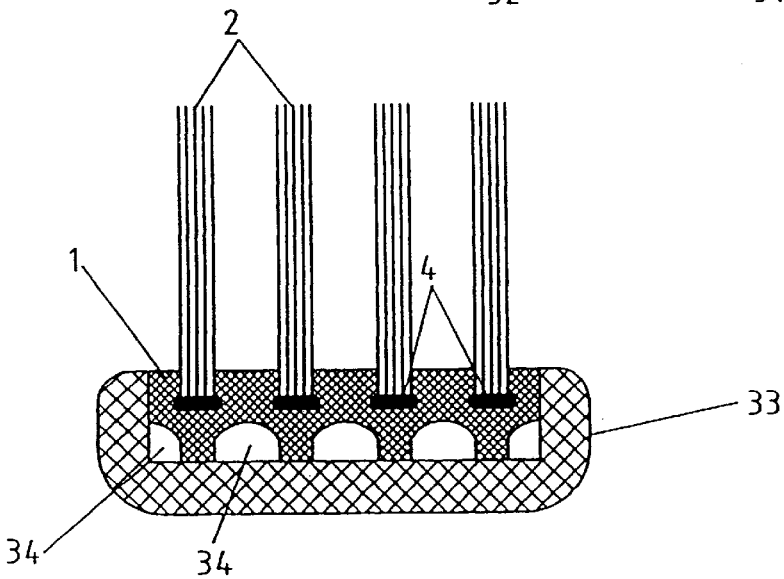
FIG. 7 depicts a cross-section through a brush in another embodiment.

FIG. 7 shows an embodiment in which the bristle carrier 1 is also inserted in a frame-like grip, handle 33 or the like. The elastomeric bristle carrier 1 has on its side remote from the bristles 2 cavities 34, so that the bristle bundles 2 have an increased mobility in the axial direction, but also in any direction at right angles to the bristle axis, in that the elastomeric bristle carrier moves back under pressure in the vicinity of the cavities 34.

Figure 8:
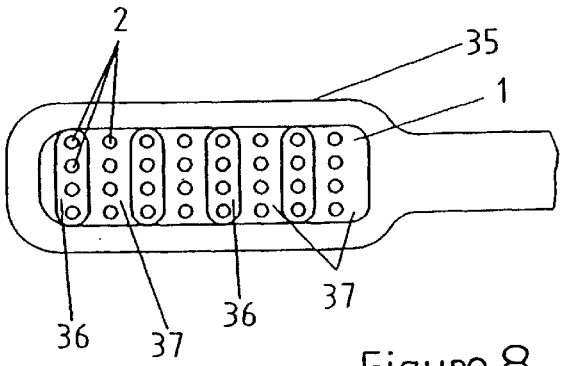
FIG. 8 is a plan view of a toothbrush head in a further variant.

In this way, e.g. a toothbrush according to FIG. 8 with the brush head 35 can be equipped with a bristle carrier 1, whose bristle bundles 2 in the areas 36 have a different mobility from those in the areas 37, so that during use the bristles can better adapt to the surfaces to be cleaned and their different contours. This can be assisted in that the recesses 5 in the bristle carrier 1 (e.g. FIG. 1) are conically outwardly widened in the vicinity of the opening rim, so that at the same time an insertion bevel for the thickened portion or punch is formed.

In place of the two-part construction, as illustrated in FIGS. 5 and 8 by a toothbrush, the handle 30 can also be made from the same material as the bristle carrier 1 and is merely made stiffer by correspondingly larger cross-sections, by inserts or envelopes, or by material restructuring, e.g. by foaming.

What is claimed is:

1. A method of manufacturing brushware, comprising the steps of:

(a) providing a bristle carrier of elastic material having at least one substantially cylindrical elongated recess, (b) providing an elongated bristle bundle having a plurality of individual bristles;

(c) melting said bristles at a fastening end thereof to form a bristle-connecting thickened portion having a traverse cross-section larger than a narrowest traverse cross-section of the recess; and (d) with the longitudinal axis of the bristle bundle aligned with the longitudinal axis of the recess, applying a force longitudinally on the thickened portion to cause a wall of the recess to elastically spring out so as to permit passage of the thickened portion, while allowing the wall to spring back after passage of the thickened portion until engagement of the wall on bristles of the bristle bundle occurs to secure the bristle bundle in the recess.

2. A method according to claim 1, wherein step (d) comprises applying the force to a projecting width of the thickened portion projecting circumferentially in an amular manner from the bristles of the bristle bundle.

3. A method according to claim 1, wherein step (d) comprises applying the force uniformly to an entire annular projecting width of the bristle bundle.

4. A method according to claim 1, wherein the bristle bundle is constructed as a hollow bundle with bristles arranged in annular manner, the thickened portion projects radially at least partially into the hollow cross-section of the bristle bundle, and wherein step (d) comprises applying the force to the radially inwardly projecting part of the thickened portion.

5. A method according to claim 1, wherein the recess in the bristle carrier has an undercut, and wherein step (d) comprises applying the force to the thickened portion on the bristle bundle until the thickened portion has reached an enlarged transverse cross-section of the recess behind the undercut.

6. A method according to claim 1, wherein:

step (a) comprises providing a bristle carrier having a plurality of recesses;

step (b) comprises providing a corresponding plurality of bristle bundles;

step (c) comprises melting the bristles of each bristle bundle; and step (d) comprises applying the force to the plurality of bristle bundles simultaneously to drive the plurality of bristle bundles into the recesses on the bristle carrier.

7. A method according to claim 1, further comprising applying an additional force to free ends of the bristle bundles.

8. A method according to claim 1, further comprising between steps (c) and (d) the additional step of placing the bristle bundle on a holder having a punch with a leading end face positioned for acting on the thickened portion on the bristle bundle, and introducing the holder, with the bristle bundle thereon, into the recess until the holder leading end face contacts the thickened portion.

9. A method according to claim 8, wherein the punch is constructed as an annular sleeve embracing the bristle bundle on the external surface thereof, and wherein said additional step includes contacting the annular end face of the sleeve against a length of the thickened portion projecting circumferentially from the bristles of the bristle bundle.

10. A method according to claim 9, wherein in an area of the annular sleeve acting on the length of the thickened portion, the annular sleeve has a first external cross-section no larger than the largest cross-section of the thickened portion and a second, larger cross-section forming a step with the first cross-section.

11. A method according to claim 10, wherein the step formed by the second cross-section forms an abutment, and wherein step (d) comprises applying the force to drive the bristle bundle into the elongated recess until the abutment contacts the surface of the bristle carrier.

12. A method according to claim 8, wherein the bristle bundle is hollow and the punch has a bolt-like construction, and wherein said additional step includes contacting a leading end face of the punch on a length of the thickened portion projecting within the hollow internal diameter of the bundle.

13. A method according to claim 12, wherein the hollow bundle thickened portion is annular, and wherein said additional step includes inserting a smaller diameter part of the punch into the center space of the annular thickened portion until a larger diameter part of the punch acts on the projecting length of the annular thickened portion.

* * * * *